US008757443B2

(12) United States Patent
Pelfrey et al.

(10) Patent No.: US 8,757,443 B2
(45) Date of Patent: Jun. 24, 2014

(54) PORTABLE DISPENSER

(75) Inventors: Keith A. Pelfrey, Wadsworth, OH (US); William Krueger, Richfield, OH (US); Michael M. Potempa, Freeport, IL (US)

(73) Assignee: GOJO Industries, Inc., Akron, OH (US)

( * ) Notice: Subject to any disclaimer, the term of this patent is extended or adjusted under 35 U.S.C. 154(b) by 81 days.

(21) Appl. No.: 13/233,719

(22) Filed: Sep. 15, 2011

(65) Prior Publication Data

US 2013/0068791 A1 Mar. 21, 2013

(51) Int. Cl.
*B05D 7/06* (2006.01)
*F21V 33/00* (2006.01)
*B65D 51/24* (2006.01)

(52) U.S. Cl.
CPC ..... *B65D 51/248* (2013.01)
USPC ..... 222/113; 222/207; 222/175; 362/96

(58) Field of Classification Search
CPC .. A45D 33/32; B65D 2203/12; B65D 51/248; A47G 2019/2238
USPC ..... 222/113, 207, 183, 504, 158–159, 165, 222/131, 191, 325, 175; 362/96, 116, 119
See application file for complete search history.

(56) References Cited

U.S. PATENT DOCUMENTS 4,449,474 A * 5/1984 Mariol ..... 116/2
5,158,356 A * 10/1992 Guthrie ..... 362/188
5,346,132 A * 9/1994 Hahn et al. ..... 239/71
5,386,351 A * 1/1995 Tabor ..... 362/201
5,573,109 A * 11/1996 Isacson ..... 206/38.1
6,676,270 B2 * 1/2004 Kostal et al. ..... 362/96
6,971,761 B2 * 12/2005 Parsons ..... 362/158
7,063,432 B2 * 6/2006 VanderSchuit ..... 362/101
7,303,300 B2 12/2007 Dowling et al.
7,311,411 B2 * 12/2007 VanderSchuit ..... 362/84
7,652,436 B2 1/2010 Dowling et al.
7,690,533 B2 4/2010 Stilley
7,703,226 B2 4/2010 Schnuckle
7,927,032 B2 * 4/2011 Sanchez ..... 401/129
8,210,395 B1 * 7/2012 Morris ..... 222/113
2005/0056663 A1 * 3/2005 Yu ..... 222/113
2005/0205605 A1 9/2005 Clapper
2006/0250795 A1 * 11/2006 Langone ..... 362/253
2007/0007304 A1 1/2007 Bitton
2007/0080168 A1 * 4/2007 Kroub ..... 222/113
2008/0055884 A1 3/2008 Victor et al.
2010/0064558 A1 * 3/2010 Pelfrey et al. ..... 40/447
2010/0084432 A1 * 4/2010 Pelfrey ..... 222/153.13
2010/0213212 A1 * 8/2010 Custodis et al. ..... 222/113
2011/0011886 A1 * 1/2011 Zaima et al. ..... 222/1
2013/0082070 A1 * 4/2013 Feriani et al. ..... 222/113

* cited by examiner

*Primary Examiner* — Kevin P Shaver
*Assistant Examiner* — Charles P Cheyney
(74) *Attorney, Agent, or Firm* — Renner, Kenner, Greive, Bobak, Taylor & Weber

(57) ABSTRACT

A portable dispenser provides a light source that is configured to illuminate a dispensing nozzle, indicia carried upon the dispenser housing, and the refill container when the dispenser is actuated to dispense material therefrom. As such, the dispenser conveniently identifies the intended region at which the material is to be dispensed, while providing a compelling and entertaining manner of operation.

7 Claims, 12 Drawing Sheets

PORTABLE DISPENSER

TECHNICAL FIELD

The present invention generally relates to dispensers of liquid material, such as soap or sanitizer dispensers. In particular, the present invention relates to portable dispensers that illuminate liquid material as it is dispensed from an outlet port. More particularly, the present invention relates to a portable dispenser that illuminates indicia carried thereon as the liquid material is dispensed.

BACKGROUND OF THE INVENTION

Recently, the public has become increasingly concerned with disease and its transmission, and as such, there is an increased awareness of the importance of hand cleansing and hygiene in general. For example, with respect to the transmission of *E. coli* in the food services industry, the rhinovirus in elementary schools, and nosocomial diseases within healthcare facilities, numerous studies have cited hand hygiene as an effective measure to guard against disease transmission. In response, health care, food service, and hotel and travel industries have been forced to examine their hygiene protocols and procedures to ensure that their personnel are adopting habits that are efficacious in the prevention of disease transmission.

In order to minimize the possibility of the transmission of bacteria or viruses by hand washing, full compliance with hand washing hygiene standards must be observed, as the failure of one individual to properly sanitize his or her hands can negate the efforts of others who come in contact with such individual. Thus, to ensure employees or other individuals have sufficient access to sanitizer, the current trend has been to permanently install full-size dispensers at designated areas throughout a building or work area. Such dispensers are rigidly affixed to a wall or counter and are capable of being refilled with sanitizer when they are emptied.

Unfortunately, such full-size, fixed dispensers require that users return to them each time they are in need of sanitizer, which is inconvenient as users generally require multiple sanitizer applications throughout the day to maintain a sanitized state. Also, if the user is required to travel out of his or her way to obtain the sanitizer from the fixed dispenser, then the user may be less motivated to sanitize his or her hands in accordance with predetermined hygiene protocols. In addition, installation of a sufficient quantity of fixed sanitizer dispensers to provide complete coverage throughout a facility, such as a hospital, requires a substantial cost, which in many cases is economically unfeasible. Moreover, in circumstances where there is a substantial number of full-size, fixed dispensers installed, an employee must periodically refill the sanitizer dispensers, which is costly and time consuming.

Alternatively, while there are portable dispensers available, they are inconvenient to refill with liquid material, such as soap or sanitizer. In addition, these portable dispensers fail to provide the necessary conveniences to facilitate the use of such portable dispensers. Furthermore, these dispensers fail to create an engaging interaction with its user in order to attract and encourage their use in the future.

Therefore, there is a need for a portable dispenser that is configured to be worn or carried by a user and that illuminates the liquid material as it is dispensed to attract the attention of users. In addition, there is a need for a portable dispenser that illuminates indicia carried thereon to attract the attention of the user to encourage the future use of the dispenser.

SUMMARY OF THE INVENTION

In light of the foregoing, it is a first aspect of the present invention to provide a portable dispenser to dispense material from a replaceable refill cartridge comprising a housing having an outlet port and a receiving cavity, said receiving cavity configured to removably receive a refill cartridge having at least one outlet aperture that carries material to said outlet port; an actuation unit having at least one dispensing aperture in operative communication with said nozzle, said actuation unit having an alignment member configured to rotatably carry a shut-off gear disposed between said at least one outlet aperture and said at least one dispensing aperture, said shut-off gear having at least one control aperture that is rotated by said actuation unit, said alignment member in optical communication with said nozzle; a motor drive attached to said actuation unit configured to actuate said shut-off gear; a light source carried by said actuation unit, said light source generating light in optical communication with said alignment member; and a switch coupled to said actuation unit and said light source; wherein when said switch is actuated, said light source is energized to illuminate said outlet port and said actuation unit moves said shut-off gear such that said at least one control aperture is substantially aligned with said at least one output aperture and said at least one dispensing aperture to allow material from the refill cartridge to be dispensed from said outlet port.

It is another aspect of the present invention to provide a portable dispenser to dispense material from a replaceable refill cartridge comprising a housing having a receiving cavity to removably receive the refill cartridge; a pump carried by said housing, said pump having an inlet and an at least partially transparent outlet nozzle that is disposed through said housing; an at least partially transparent tube extending from said inlet of said pump into said receiving cavity to receive material from the refill cartridge; a light source carried by said housing, said light source generating light that is in optical communication with said tube and said outlet nozzle; and a switch coupled to said light source, said switch in operative engagement with said pump, wherein when said pump is actuated, said pump dispenses material from the refill container and said switch is actuated to activate said light source to illuminate said outlet nozzle and said tube.

Yet a further aspect of the present invention is to provide a portable dispenser to dispense material from a replaceable refill cartridge comprising a housing having an outlet port and a receiving cavity, said receiving cavity configured to removably receive a refill cartridge having at least one outlet aperture that carries material to said outlet port; an actuation unit carried by said housing, said actuation unit comprising a piezoelectric screen disposed in said outlet port; a frequency generator coupled to said piezoelectric screen; and a switch coupled to said piezoelectric screen and said frequency generator; and a light source coupled to said switch, said light source generating light in optical communication with said outlet port; wherein when said switch is actuated, said light source is energized to illuminate said outlet port and said screen is activated to allow material from the refill cartridge to pass therethrough and dispensed at said outlet port.

BRIEF DESCRIPTION OF THE DRAWINGS

These and other features and advantages of the present invention will become better understood with regard to the following description, appended claims, and accompanying drawings wherein:

DETAILED DESCRIPTION OF THE INVENTION

Figure 1:
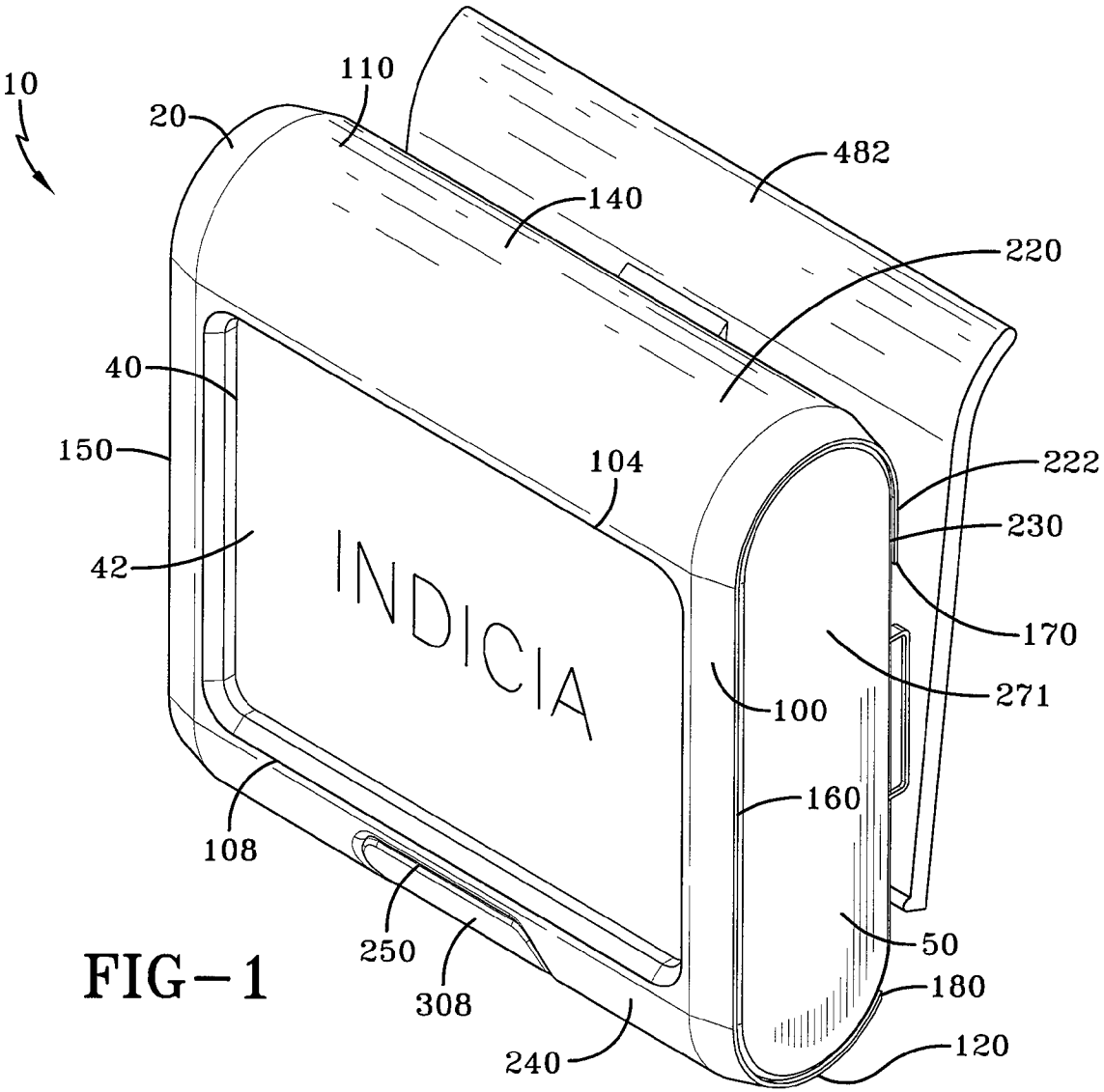
FIG. 1 is a perspective view of a portable dispenser in accordance with the concepts of the present invention.
Figure 3:
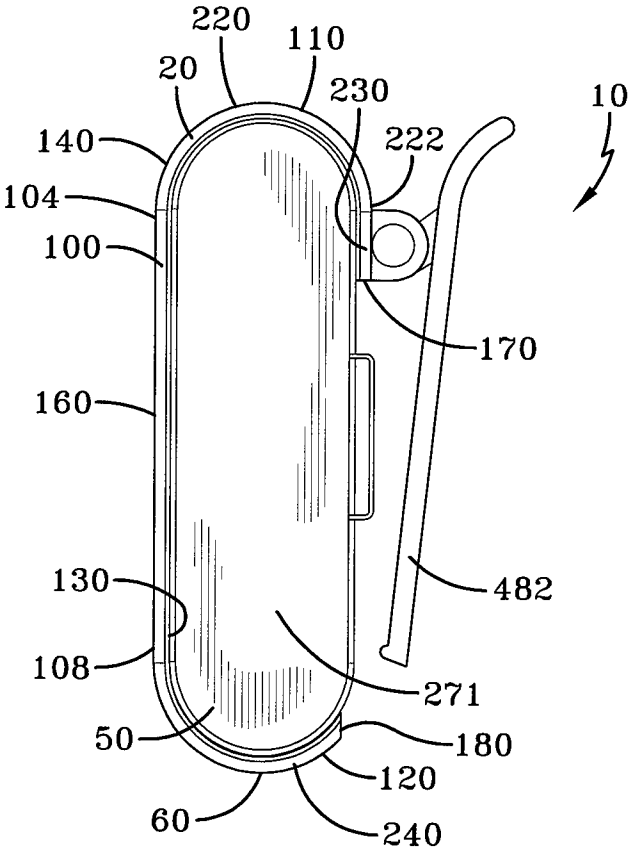
FIG. 3 is a side elevational view of the portable dispenser in accordance with the concepts of the present invention.
Figure 2:
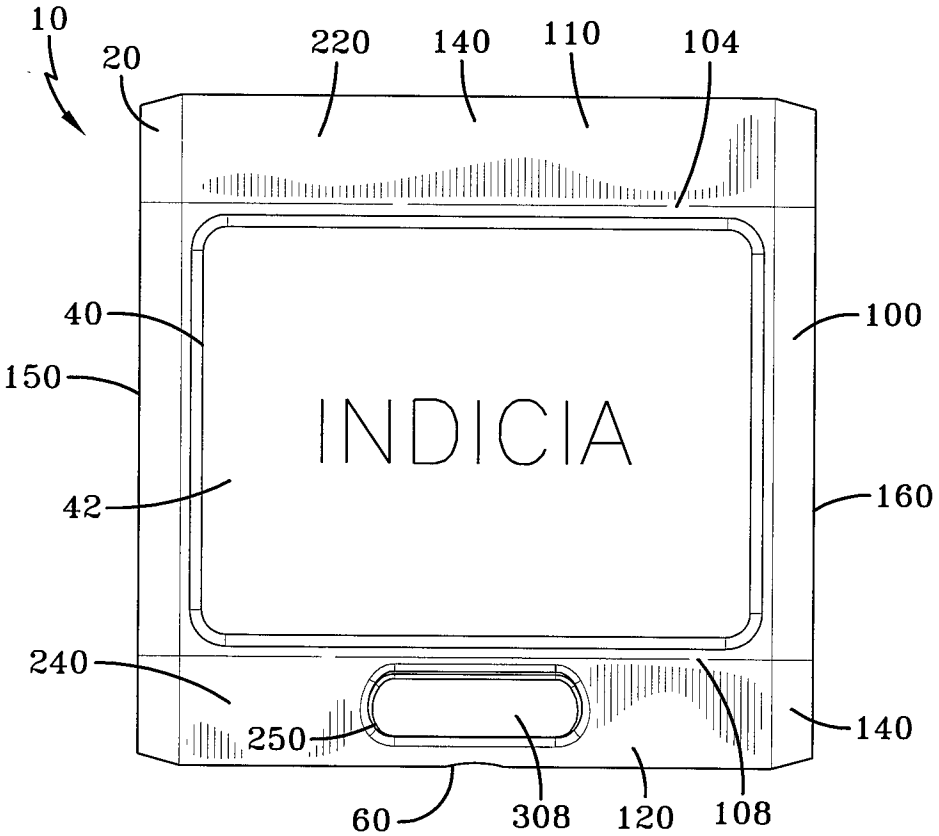
FIG. 2 is a front elevational view of the portable dispenser in accordance with the concepts of the present invention.
Figure 4:
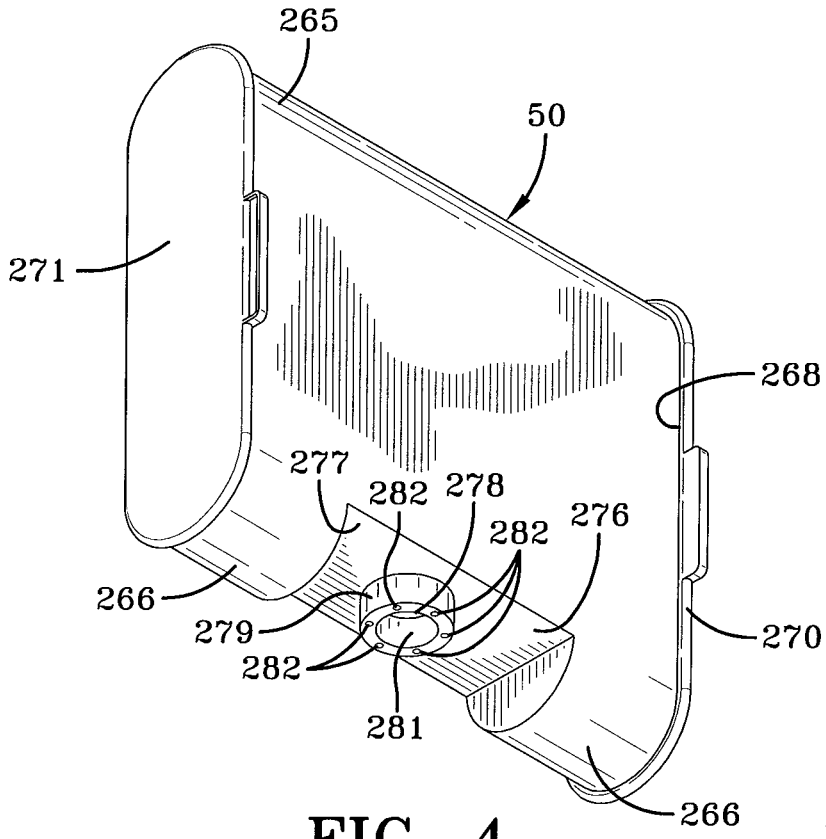
FIG. 4 is a perspective view of a refill cartridge used by the portable dispenser in accordance with the concepts of the present invention.
Figure 5:
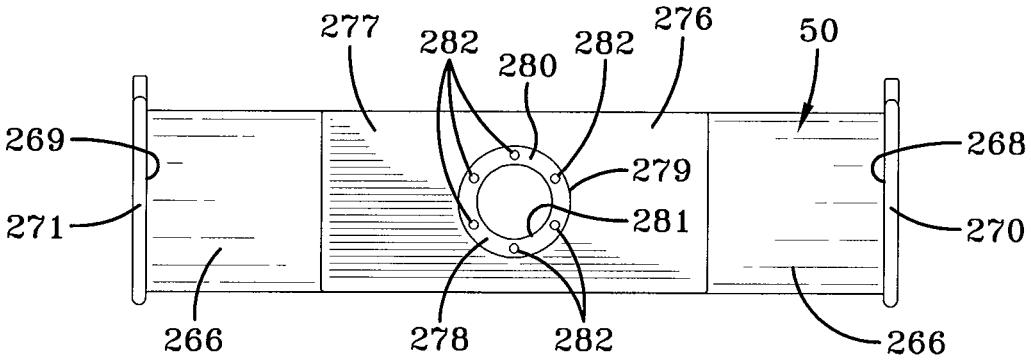
FIG. 5 is a bottom plan view of the refill cartridge in accordance with the concepts of the present invention.

A portable dispenser that is worn by an individual is generally referred to by numeral 10, as shown in FIGS. 1-11 of the drawings. The dispenser 10 comprises a housing 20 that includes a window aperture 40 in which physical indicia 42, such as a lenticular image, is disposed. A refill cartridge 50 containing any desired liquid material, such as soap, sanitizer, or moisturizer for example, is configured to be removably inserted into the housing 20 so that the liquid material can be selectively dispensed from an outlet port 60 provided by the dispenser 10. A light source 70, such as an LED (light emitting diode), is in optical communication with the refill cartridge 50, the physical indicia 42, and the outlet port 60. When the dispenser 10 is actuated, a motorized dispensing unit 80 dispenses the liquid material from the refill cartridge 50 through the outlet port 60, while light generated by the light source 70 is carried through the dispenser 10 to simultaneously illuminate the outlet port 60, the refill cartridge 50, and the indicia 42. As such, the illumination of the outlet port 60 of the dispenser 10 provides a convenient manner for allowing a user to identify where the liquid material will be dispensed, while the illumination of the indicia 42 provides a dynamic, entertaining, and aesthetically-pleasing image that captures the attention of the user.

Specifically, the housing 20 of the dispenser 10 comprises a substantially planar main section 100 having opposed ends 104 and 108 from which extend respective upper and lower curved arms 110 and 120. The main section 100 and the curved arms 110,120 include opposed inner and outer surfaces 130 and 140, which are bounded by lateral edges 150 and 160 and terminal edges 170 and 180. The curved arms 110 and 120 partially extend behind inner surface 130 of the main section 100 and are spaced from the inner surface 130 of the main section 100 to form upper and lower receiving channels 200 and 210 that are configured to slideably receive the refill cartridge 50 therein. Specifically, the upper curved arm 110 includes a curved member 220 that is disposed between the edge 104 and an edge 222, and an extension section 230 that extends from the edge 222 and that is terminated at edge 170. In one aspect, the extension section 230 is substantially parallel to the main section 100 and spaced therefrom to thus define the upper receiving channel 200. In addition, the lower curved arm 120 is defined by a curved member 240 that extends from edge 108 to an edge 242. As such, because the upper curved arm 110 includes the extension section 230, the depth of the upper receiving channel 200 is greater than that of the lower receiving channel 210. Moreover, the radius of curvature of the upper and lower curved members 220,240 is equivalent; however, the lower curved member 240 is configured such that edge 180 is offset at a point below the inner surface 130 of extension section 230. Such a configuration facilitates the removable attachment of the refill container 50 to the housing 20 in a manner to be discussed.

In addition, the main section 100 of the housing 20 includes the window aperture 40 in which the physical indicia 42 is disposed using any suitable means of fixation, such as adhesive. However, it should be appreciated that while the window aperture 40 may be configured to carry the indicia 42 therein, the indicia 42 may alternatively be carried by the refill cartridge 50 so that it shows through the window aperture 40. The physical indicia 42 may comprise any physical medium, such as transparent or semi-transparent media, formed of any suitable material, such as plastic, paper, or the like. In one aspect, the physical indicia 42 may comprise a lenticular image, which provides a transparent or partially-transparent three-dimensional image. In yet another aspect, an indicia holder (not shown) may be disposed on the inner surface 130 of the main section 100 of the housing 20, so that the physical indicia 42 can be selectively inserted or removed from the dispenser 10. The housing 20 also includes an engagement aperture 250 and the outlet port 60, whereby the engagement aperture 250 is disposed below the window aperture 40 and through the lower curved arm 120, while the outlet port 60 is disposed through the lower curved arm 120 at a point below the engagement aperture 250.

The refill cartridge 50 is configured to have a shape complementary to the upper and lower receiving channels 200,210 of the dispenser housing 20 to allow it to be removably inserted therein. Specifically, the refill cartridge 50 includes a central section 262 having a substantially rectangular cross-sectional shape. The central section 262 is disposed between respective upper and lower curved sections 265 and 266, which are dimensioned to be received within the respective upper and lower receiving channels 200,210 of the dispenser housing 20. In addition, lateral ends 268 and 269 of the central section 262 include respective retainers 270 and 271 that include respective edges 272,273 that extend beyond that of the central section 100 and the curved sections 265, 266. Disposed in the lower curved section 266 of the refill cartridge 50 is an attachment channel 276 having a base surface 277 from which extends an outlet member 278. The outlet member 278 comprises a substantially annular wall 279 that is terminated at its free end by an engagement surface 280. The annular wall 279 defines a substantially annular receiving port 281 that is circumscribed by one or more outlet apertures 282 that are disposed in the engagement surface 280 that fluidly carry liquid material from the refill cartridge 50. That is, the outlet ports 282 are configured to transfer liquid material out of the refill cartridge 50 when the motorized dispensing unit 80 is actuated in the manner to be discussed.

In addition, the attachment channel 276 is dimensioned to receive an actuation unit 300 therein, which provides the illumination and dispensing functions carried out by the light source 70 and the motorized dispensing unit 80. It should be appreciated that the refill cartridge 50, including the outlet member 278, may be formed of any suitable material, such as transparent or at least partially transparent plastic that is configured to carry, transmit, or otherwise be illuminated by the light source 70. Moreover, the refill cartridge 50 may carry any desired liquid material, such as soap, sanitizer, or moisturizer, for example. It should be appreciated that the refill cartridge 50 may include a recessed surface 302 that is disposed on the central section 262, which may carry the indicia 42 thereon.

Figure 6:
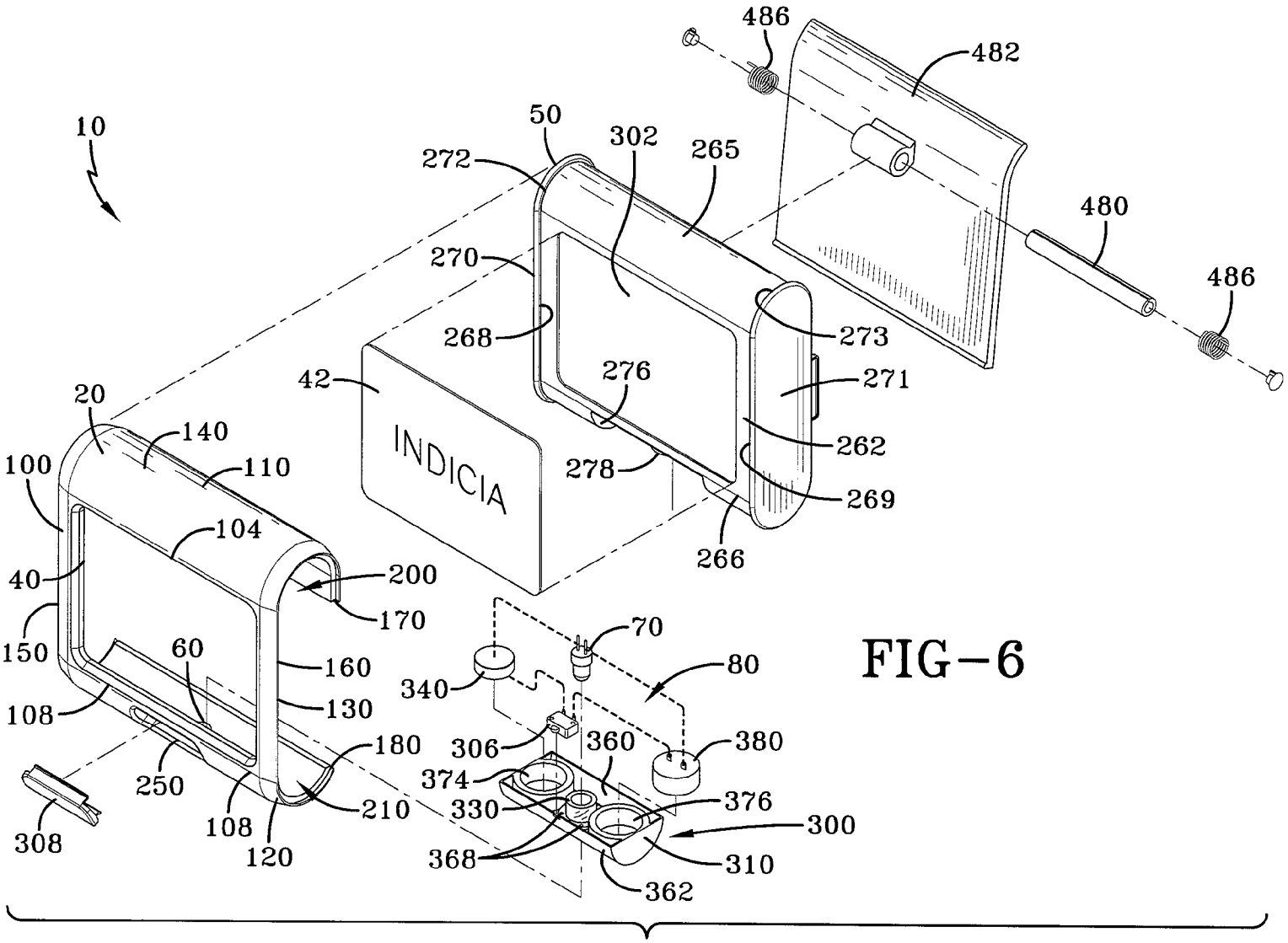
FIG. 6 is an exploded view of the portable dispenser showing the refill cartridge removed from the dispenser in accordance with the concepts of the present invention.
Figure 7:
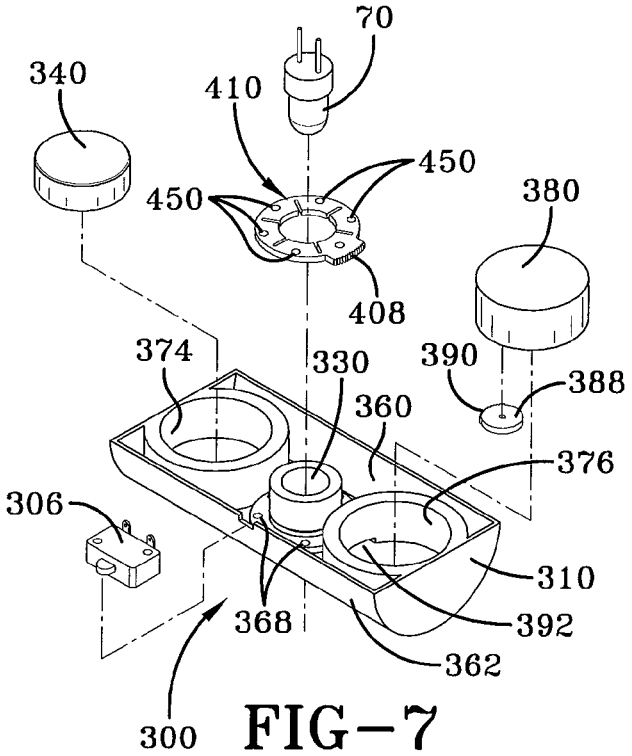
FIG. 7 is an exploded view of an actuation unit utilized by the dispenser in accordance with the concepts of the present invention.
Figure 8:
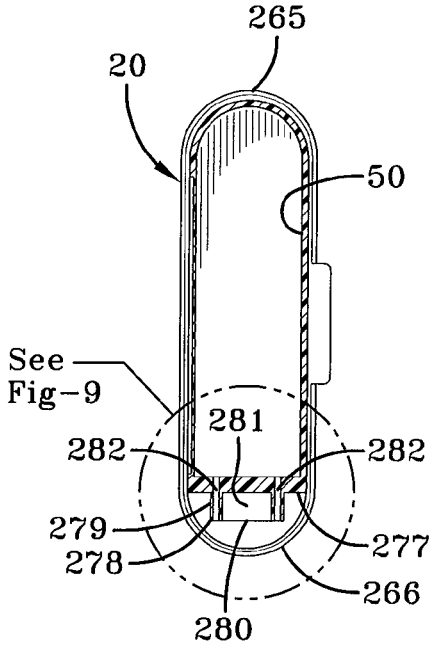
FIG. 8 is a cross-sectional side view of the refill cartridge and actuation unit of the dispenser in accordance with the concepts of the present invention.
Figure 9:
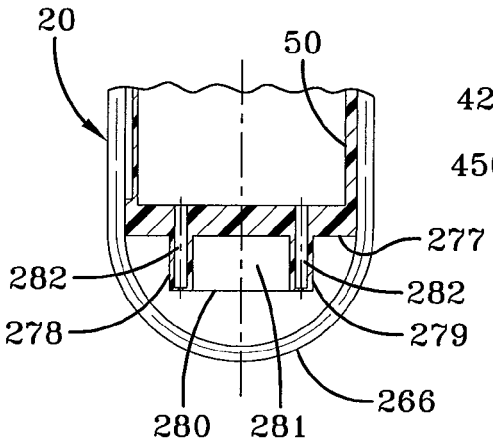
FIG. 9 is a cross-sectional view of the outlet apertures of the refill cartridge used by the dispenser in accordance with the concepts of the present invention.
Figure 10:
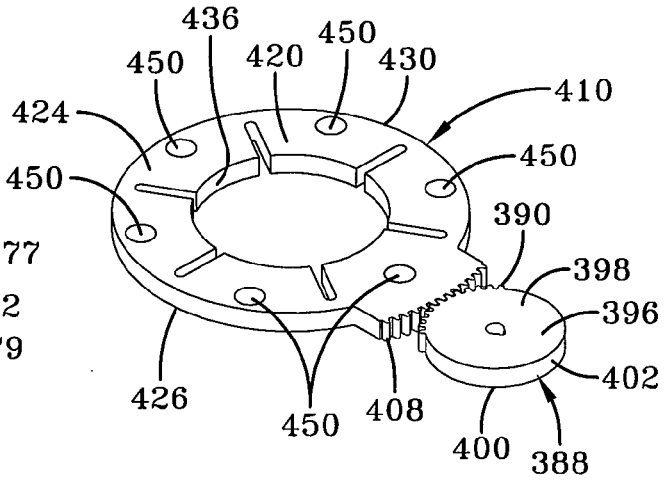
FIG. 10 is a perspective view of a shut-off gear and a drive gear provided by the actuation unit in accordance with the concepts of the present invention.
Figure 11:
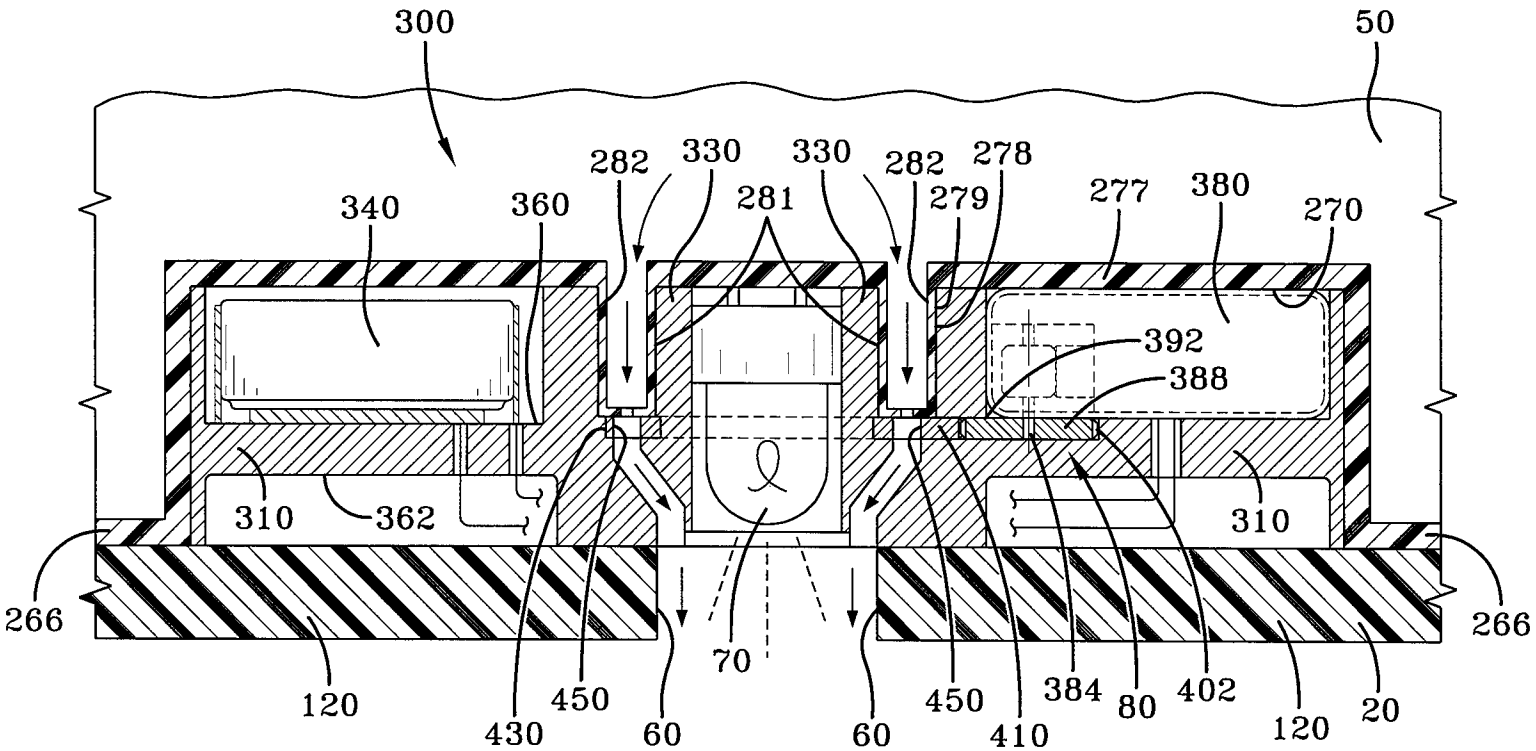
FIG. 11 is a cross-sectional view of the actuation unit and the refill cartridge inserted in the dispenser housing in accordance with the concepts of the present invention.

The actuation unit 300, as shown in FIG. 6, is configured to be inserted into the attachment channel 276 of the refill cartridge 50 and includes a switch 306 that is configured to be actuated by a button 308 that is disposed through engagement aperture 250 of the housing 20. That is, when the actuation unit 300 is placed into the attachment channel 276 of the refill cartridge 50, such that the alignment member 330 of the actuation unit 300 is received within the receiving port 281 of the refill cartridge 50, and then placed in the dispenser 10, the switch 306 operatively engages the button 308 that is received through the engagement aperture 250. As such, when the button 308 is actuated (depressed or released), the dispenser 10 is placed into respective ON or OFF states. Moreover, the actuation unit 300 includes a base 310 upon which the various components of the actuation unit 300, including the switch 306 and light source 70, are attached or otherwise carried. In one aspect, the base 310 may be formed from any suitable material, such as plastic for example, which may be transparent or partially transparent light-carrying material. Furthermore, the various portions of the base 310 to be discussed may serve as a light pipe that is able to route light generated by the light source 70 to various portions of the dispenser 10, such as to illuminate the indicia 42 and the outlet port 60 in the manner to be discussed. The base 310 includes a substantially annular alignment member 330 that is configured to be received within the receiving port 281 of the refill cartridge 50, while a power source 340, the motorized dispensing unit 80, the light source 70, and the switch 306 are attached thereabout. Specifically, the motorized dispensing unit 80, the light source 70, the power source 340, and the switch 306 are coupled in series, such that when the switch 306 is placed in an ON state by depressing the button 308, the motorized dispensing unit 80 and the light source 70 are activated, and when the switch 306 is released so as to place the dispenser 10 in an OFF state, the motorized dispensing unit 80 and the light source 70 are deactivated. It should be appreciated that the light source 70 may comprise any suitable source of light, such as an LED (light emitting diode), laser light, or incandescent light for example, while the switch 306 may comprise any suitable switch, such as a micro-switch. Specifically, as shown in FIG. 6, the light source 70 is disposed in the annular alignment member 330, whereupon the light-carrying properties of the base 310 distribute the light to various parts of the dispenser 10, including the outlet member 278 of the refill cartridge 50 and the outlet port 60 of the housing 20. Furthermore, the power source 340 comprises any suitable portable source of power, such as a battery or photovoltaic cell for example.

Additionally as shown clearly in FIGS. 6-11, the base 310 includes an inner surface 360 and an outer surface 362, such that the alignment member 330 extends from the inner surface 360. Disposed about the periphery of the alignment member 330 are one or more dispensing apertures 368 that extend through the base 310 and that are arranged to be in substantially axial alignment with the outlet apertures 282 of the refill cartridge 50 when the actuation unit 300 is coupled to the refill container 50, such that the alignment member 330 is received within the receiving port 281 of the refill cartridge 50. Also extending from the inner surface 360 of the base 310 on either side of the alignment member 330 is a battery holder 374 and a motor holder 376. The battery holder 374 is configured to retain the power source 340 therein while the motor holder 376 is configured to retain a motor drive 380 therein.

Continuing, the motor drive 380 includes a rotating shaft 384 that is attached to a drive gear 388 that includes drive teeth 390 that are received through a drive aperture 392 disposed through the motor holder 376 of the base 310. Specifically, the drive gear 388 comprises a substantially annular body 396 having substantially planar upper and lower surfaces 398 and 400 bounded by an outer edge 402, such that the drive teeth 390 extend from a portion of the edge 402. The drive teeth 390 are configured to operatively engage gear teeth 408 provided by a shut-off gear 410 that is rotatably attached to the annular alignment member 330 of the actuation unit 300, in a manner to be discussed.

The shut-off gear 410 comprises a substantially annular body 420 having substantially planar upper and lower surfaces 424 and 426 that are bounded by an outer edge 430. Disposed through the body 420 of the shut-off gear 410 is a centrally-disposed annular mounting aperture 436 that is dimensioned to receive the transfer port 330 therein, thus allowing the shut-off gear 410 to rotate thereabout. The shut-off gear 410 also includes one or more control apertures 450 that are disposed in a region between the annular mounting aperture 436 and the outer edge 430 of the body 420. In addition, the shut-off gear 410 includes gear teeth 408 that are configured to extend from a portion of the outer edge 430. That is, both the drive teeth 390 of the drive gear 388 and the gear teeth 408 of the shut-off gear 410 do not circumscribe the entire perimeter of their respective edges 402, 430 but rather extend about only a portion of their respective outer edges 402 and 430.

Thus, during operation of the motorized dispensing unit 80, the motor drive 380 rotates the drive gear 388 via the shaft 384 so as to control the flow of liquid material supplied from the refill container 50 out of the dispensing apertures 368 and out of the outlet port 60 of the housing 20. Specifically, when the actuation unit 300 is OFF (the button 308 is not depressed), the shut-off gear 410 is rotated into a position, such that the control apertures 450 carried thereby are not axially aligned with both the outlet apertures 282 of the refill container 50 and with the dispensing apertures 368 of the base 310, thus preventing the flow of material out of dispensing apertures 368 and the outlet port 60 of the housing 20. Alternatively, when the actuation unit 300 is ON (the button 308 is depressed), the shut-off gear 410 is rotated into a position, such that the control apertures 450 carried thereby are axially aligned with the outlet apertures 282 of the refill container 50 and with the dispensing apertures 368 of the base 310, thus allowing the flow of material from the refill cartridge 50 (via the outlet apertures 282, control apertures 450, and dispensing apertures 368) and out of the outlet port 60 of the housing 20.

Moreover, because the light source 70 is disposed within the base 310 and within the alignment member 330, light is carried by the alignment member 330 to the receiving port 281 of the refill cartridge 50, where it radiates to illuminate the refill cartridge 50 and any indicia 42 in the proximity thereto. Moreover, because the alignment member 320 is axially aligned with the outlet port 60 of the housing 20, the light carried by the alignment member 330 illuminates the liquid material being dispensed through the dispensing apertures 368 and out of the outlet port 60. Thus, the outlet port 60 of the dispenser housing 20 may be formed of transparent or at least partially transparent material that is configured transmit light supplied by the light source 70 via the alignment member 330.

Attached to the outer surface 140 of the upper curved arm 110 by a shaft 480 is a retention clip 482 that is compressively biased against the refill cartridge 50 by a spring 486. As such, the retention clip 482 allows the dispenser 10 to be removably coupled to a user's belt, pocket, or other item in a convenient manner.

Thus, during operation of the dispenser 10, the user depresses the actuation button 308 to actuate the switch 306 in order to place the dispenser 10 into an ON state, whereby the light source 70 supplies light to the base 310, including the alignment member 330 and the receiving port 281 of the refill cartridge 50 in which the alignment member 330 is received, so as to illuminate the outlet port 60, the refill cartridge 50, and the adjacent indicia 42. Simultaneously with the illumination of the outlet port 60 and the indicia 42, liquid material from the refill cartridge 50 is dispensed from the outlet port 60 by the motorized dispensing unit 80, as previously discussed. Upon releasing the button 308, the switch 306 is disengaged, and the dispenser 10 is placed into an OFF state, whereby the light source 70 and motor drive 380 are turned off, thus ceasing the dispensement of material from the refill cartridge 50. As such, the dispenser 10 provides a convenient, compelling, and entertaining method of dispensing liquid material from the refill cartridge 50.

Figure 12:
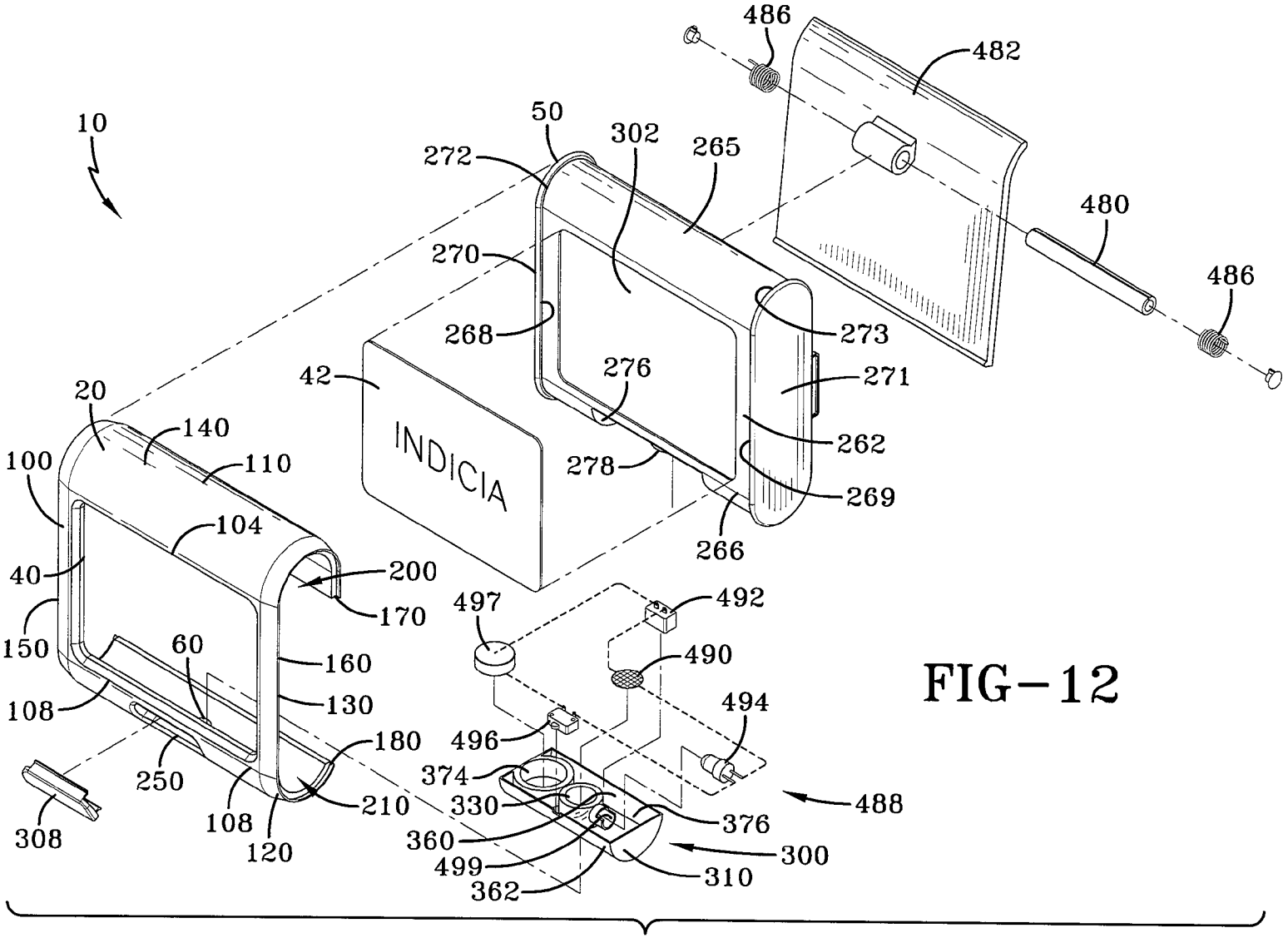
FIG. 12 is an exploded view of an alternative dispenser utilizing a piezoelectric screen to dispense liquid material in accordance with the concepts of the present invention.
Figure 14:
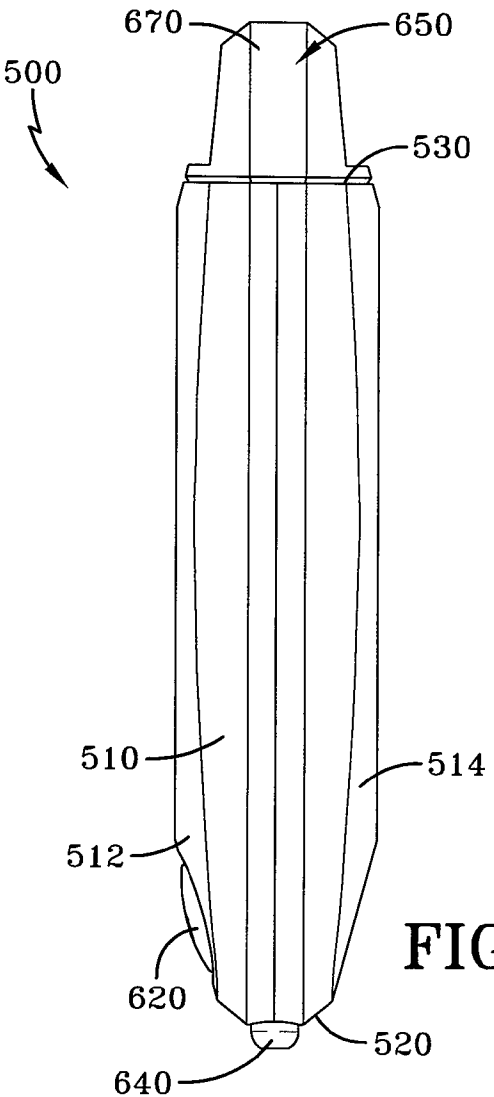
FIG. 14 is a side elevational view of the alternative portable dispenser in accordance with the concepts of the present invention.
Figure 13:
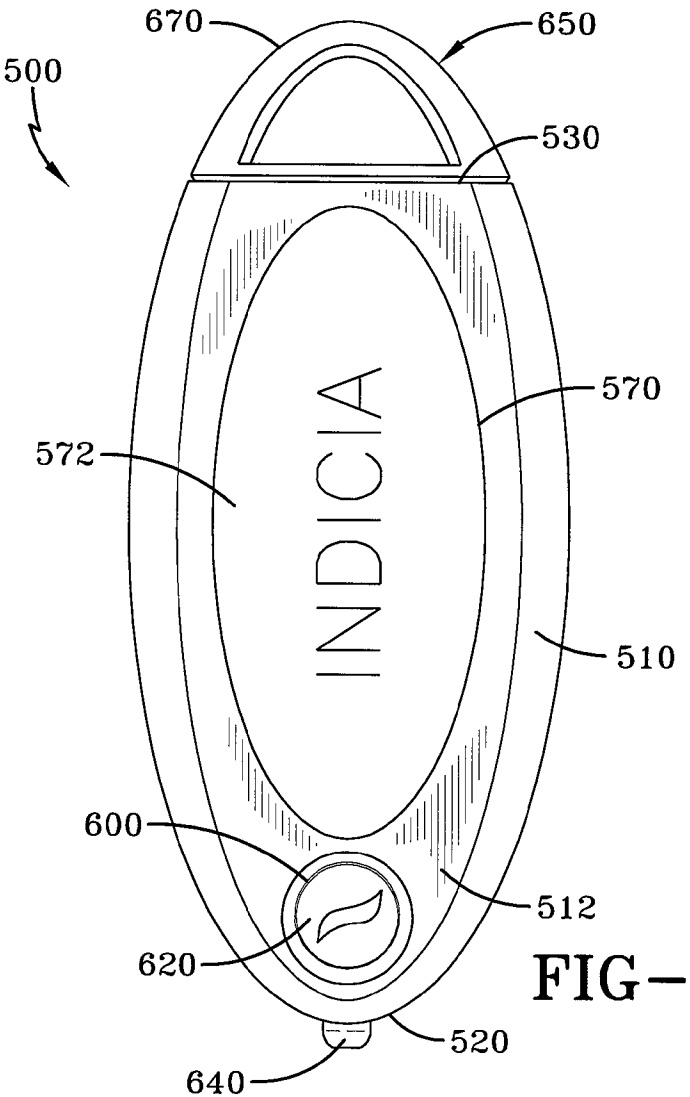
FIG. 13 is a front elevational view of an alternative portable dispenser in accordance with the concepts of the present invention.
Figure 15:
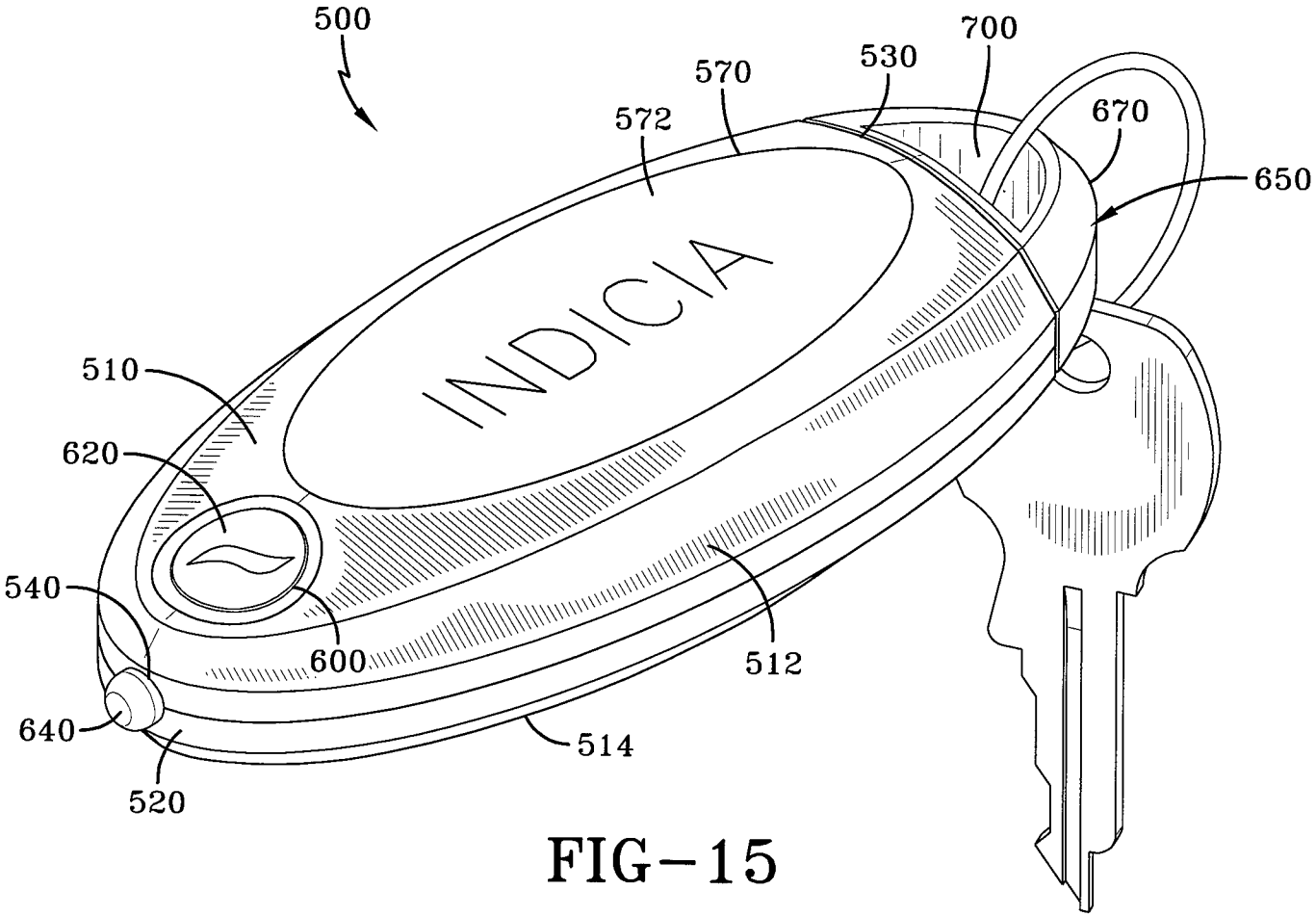
FIG. 15 is a perspective view of the front of the alternative portable dispenser with an installed refill cartridge in accordance with the concepts of the present invention.

Another embodiment of the portable dispenser 10 is shown in FIG. 12 of the drawings, whereby the motorized dispensing unit 80 is replaced with a piezoelectric dispensing unit 488 that is carried by the base 310 previously discussed. The dispensing unit 488 includes a screen 490 formed of piezoelectric material that is coupled to a frequency generator 492. A light source 494, such as an LED (light emitting diode), is also coupled to the piezoelectric screen 490 and to a switch 496 that is actuated by depression of the button 308. In one aspect, it should be appreciated that the switch 496 may comprise any suitable switching device, such as a microswitch for example. In addition, the light source 494 and the frequency generator 492 are powered by a power source, such as a battery 497. Specifically, the piezoelectric screen 490 is disposed in the annular alignment member 330 of the base, such that when the switch 496 is actuated upon the depression of the button 308, the frequency generator 492 applies an electrical signal of a suitable frequency, such as 60 Hz for example, to the piezoelectric screen 490 creating a low pressure region below the screen 490 and adjacent to the outlet port 60 of the housing 20 allowing the material to be dispensed from the refill cartridge 50. It should be appreciated that the light source 494 is carried in a retention housing 499 that is made integral with the annular alignment member 330 to allow light to be carried from the LED 494 to the outlet port 60 and surrounding regions, so as to illuminate the material as it is dispensed therefrom. In one aspect, the annular alignment member 330 and the retention housing 499 may be formed of at least partially transparent material to facilitate the illumination of the outlet port 60 and the surrounding regions. Alternatively, when the button 308 is released, the piezoelectric screen 490 is deactivated, thereupon preventing material from the refill cartridge 50 from passing therethrough and out of the outlet port 60.

It should be appreciated that while the dispenser 10 may be configured to utilize a motorized or piezoelectric pump or dispensing unit as discussed above, the dispenser 10 may be configured with any suitable pumping device.

Another embodiment of the portable dispenser, referred to by numeral 500, is shown in FIGS. 13-17 of the drawings. The portable dispenser 500 includes an elongated housing 510 having opposed front and rear sections 512 and 514 that are bounded by opposed nozzle and receiving ends 520,530. The nozzle and receiving ends 520,530 include respective nozzle and receiving apertures 540 and 550 that open into a receiving cavity 560, shown in FIG. 16. A window aperture 570 is disposed through the front section 512 of the housing 510 and is configured to receive physical indicia 572 therein. It should be appreciated that the indicia 572 may comprise any physical medium, such as that previously discussed above with regard to dispenser 10. Also disposed through the front section 512 is an actuator aperture 600 that includes a button 620 therein, which controls the operation of an actuation assembly 630 in a manner to be discussed.

Figure 16:
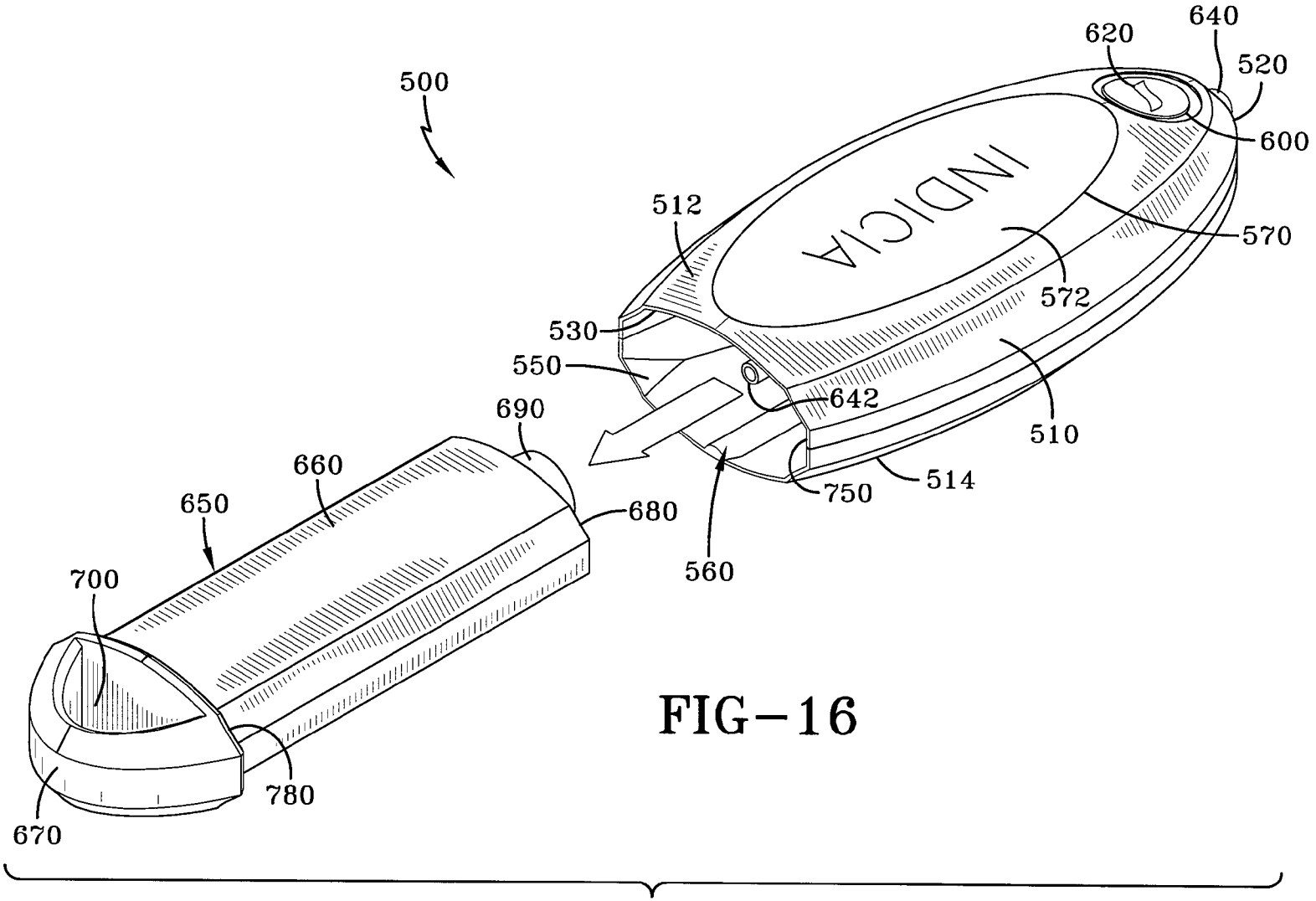
FIG. 16 is a perspective view of the alternative portable dispenser showing a refill cartridge removed from the dispenser in accordance with the concepts of the present invention.
Figure 17:
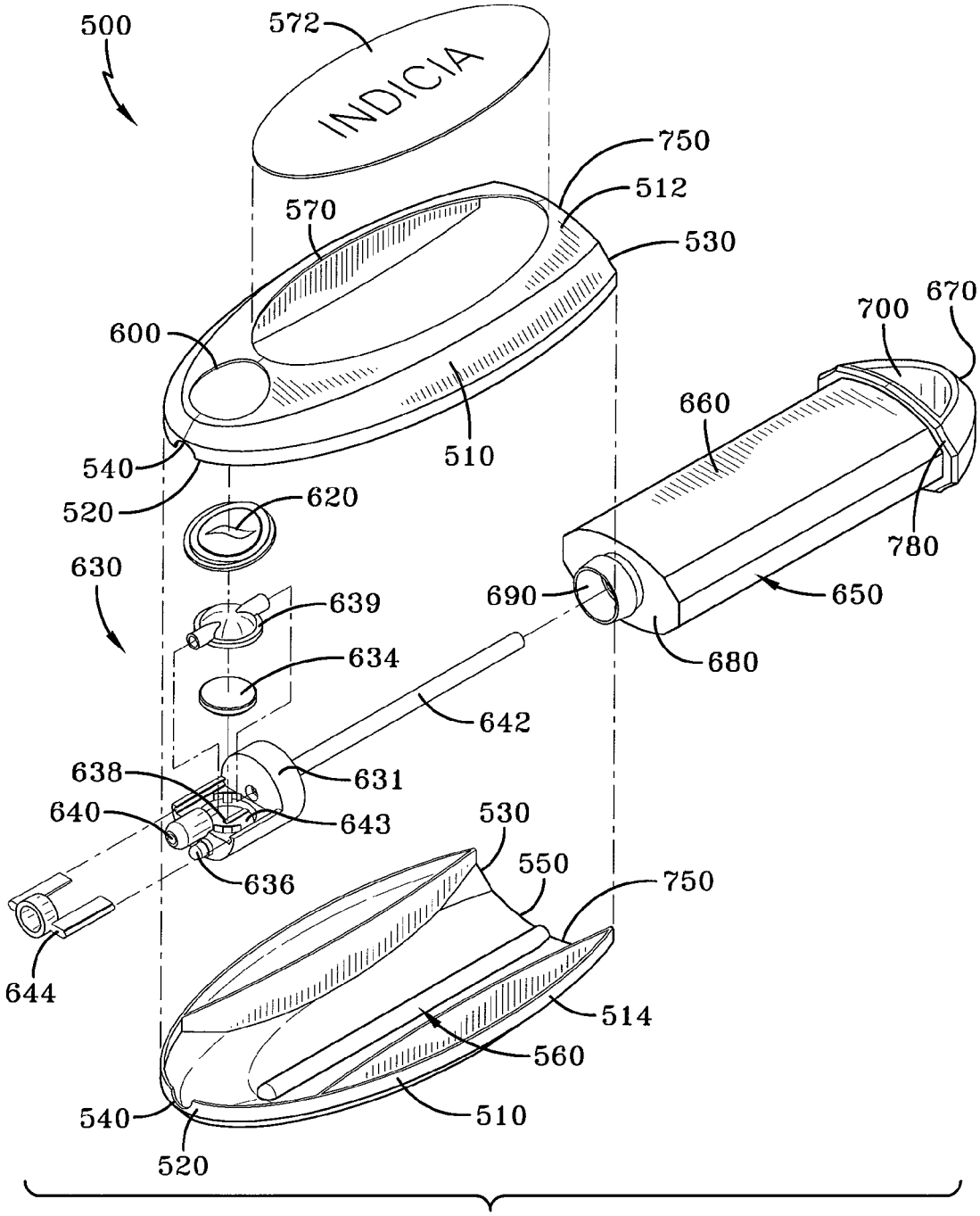
FIG. 17 is an exploded view of the alternative portable dispenser in accordance with the concepts of the present invention.

The actuation assembly 630, shown in FIG. 17, includes a body 631 that carries a power source 634 that is coupled to a light source 636 using any suitable technique. The power source 634 may comprise any suitable source of power, such as a battery or a photovoltaic cell for example. Additionally, the light source 636 may comprise any suitable source of light, such as an LED (light emitting diode), laser light, or incandescent light for example. The illumination of the light source 636 is controlled by a switch member 638, such as a micro-switch or a pre-formed wire tab, that is coupled between the light source 636 and the power source 634. The actuation assembly 630 also includes a dome pump 639 that is in fluid communication with an outlet nozzle 640 provided by the body 631 and a tube 642, such as a hollow light pipe or straw, that is configured to extend into the cavity 560 of the dispenser housing 510, as shown in FIGS. 16 and 17. Specifically, the dome pump 639 is disposed upon the battery 634, which is separated from an electrical contact 643 by the switch member 638.

In one aspect, the dome pump 639 and the battery 634 may be retained to the body 631 by a retention clip 644 that is slideably attached to the body 631. The light source 636 is coupled between the electrical contact 643 and the battery 634. The switch 638 comprises a pre-bent conductive wire that serves to bias the battery 634 so that it normally prevents the battery 634 from contacting the electrical contact 643, and as such the contact 643 and the switch member 638 together forms a switch. That is, the switch member 638 may comprise a preformed wire or tab that is pre-bent to normally separate the battery 634 from the electrical contact 643 so that the light 636 is normally off, but may be deflected upon depressing, or otherwise actuating, the dome pump 639 downward, so as to electrically connect the battery 634 to the electrical contact 643 in order to illuminate the LED 636. The button 620 is disposed upon the dome pump 639, such that during operation of the dispenser 500, when the button 620 is pressed or actuated the dome pump 639 is compressed to dispense material from the cartridge 650 via the tube 642, while simultaneously moving the switch member 638 to connect the battery 634 to the electrical contact 643, which results in the illumination of the light source 636. It should be appreciated that the tube 642 may comprise any suitable light-carrying material, such as transparent or at least partially transparent material. For example, the tube 642 may comprise transparent or at least partially transparent plastic, so as to function as a light pipe to carry light into the receiving cavity 560 in order to illuminate indicia. The dome pump 639 and the switch member 638 are configured to be disposed beneath the button 620, so as to be in operative communication therewith.

A refill cartridge 650 is configured to be received through the receiving aperture 550 and within the cavity 560 of the dispenser housing 510. The refill cartridge includes a vessel 660 having an opposed base end 670 and a receiving end 680 that includes an outlet port 690 disposed therein. Disposed in the base end 670 of the refill cartridge 650 is an attachment aperture 700 that is configured to allow any suitable cord or tether to be attached thereto to allow the refill cartridge 650 to be attached to any suitable item, such as a belt loop. Thus, when the refill cartridge 650 is inserted into the receiving cavity 560 via the receiving aperture 550 of the dispenser 500, the illuminated light tube 642 is received in the outlet port 690 of the refill cartridge 650, so as to be in fluid communication with the liquid material in the vessel 660. Circumscribing the receiving aperture 550 of the dispenser housing 510 is an attachment edge 750 that is configured to operatively engage an engagement edge 780 that circumscribes the base end 670 of the refill cartridge 650. That is, the engagement edge 780 and the attachment edge 750 are configured to snap-fit together, so as to securely join and retain the refill cartridge 650 to the dispenser housing 510.

Thus, when the vessel portion 660 of the refill cartridge 650 is placed within the receiving cavity 560 of the dispenser housing 510, the illuminated tube 642 is received within the receiving aperture 690 of the vessel 660. As the refill cartridge 650 is fully inserted within the receiving cavity 560, the engagement edge 780 of the base end 670 is snap-fit to the attachment edge 750 of the receiving aperture 550 that is provided by the dispenser housing 510. Once the refill cartridge 650 is attached to the dispenser housing 510, the depression of the button 620 results in the illumination of the light source 636, which generates light that is carried by the tube 642 into the vessel 660 of the refill cartridge 650. It should be appreciated that the refill cartridge 650 may comprise any suitable transparent or at least partially transparent material that allows the light carried by the tube 642 to radiate therefrom and through the indicia 572 disposed in the indicia aperture 570 of the housing 510. In addition to illuminating the tube 642, the depression or actuation of the button 620 also actuates or compresses the dome pump 639, causing liquid material to be drawn from the refill cartridge 650 via the tube 642, whereupon it is dispensed from the outlet nozzle 640 that is also illuminated by the light source 636. As such, the illuminated nozzle of the dispenser 10 allows the user to see the intended direction at which the liquid material is being dispensed, while the illuminated tube 642 illuminates the indicia 572 in an aesthetically pleasing manner.

Figure 18:
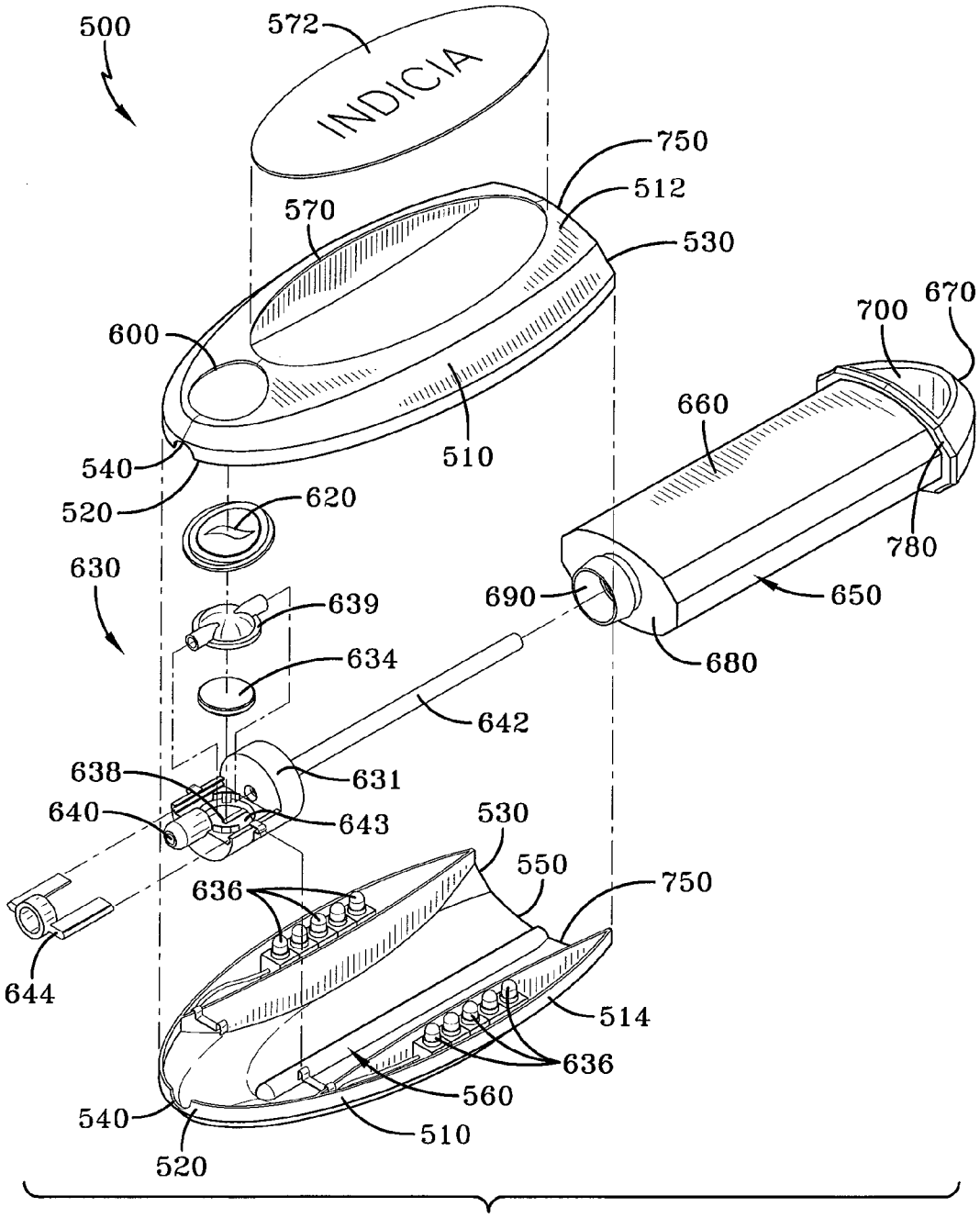
FIG. 18 is an exploded view of another alternative portable dispenser in accordance with the concepts of the present invention.

In yet another embodiment of the dispenser 500, as shown in FIG. 18, the front or rear sections 512,514 of the housing 510 may be configured to include one or more light sources 800 in place of or in addition to the light source 636 previously discussed. In one aspect, the light sources 800 may comprise one or more LEDs (light emitting diodes) or the like. Specifically, the LED's 800 may be disposed along one or more of the lateral edges 810 and 812 of the front and or rear sections 512,514 of the housing 510. This configuration allows the light generated therefrom to illuminate the indicia 572 carried by the window aperture 570 of the housing 510, as well as other portions of the housing 510.

It should be appreciated that while the dispenser 500 may be configured to utilize a dome pump, as discussed above, the dispenser 500 may be configured to utilize any suitable pumping device.

It will, therefore, be appreciated that one advantage of one or more embodiments of the present invention is that a portable dispenser directs light about a dispensing nozzle as liquid material is dispensed therefrom. Another advantage of the present invention is that the portable dispenser directs light to illuminate the indicia as liquid material is dispensed therefrom. Still another advantage of the present invention is that the portable dispenser utilizes a battery-powered motorized pump to dispense liquid material from the refill cartridge. Yet another advantage of the present invention is that the portable dispenser utilizes a piezoelectric screen to control the dispensing of material from a refill cartridge.

Although the present invention has been described in considerable detail with reference to certain embodiments, other embodiments are possible. Therefore, the spirit and scope of the appended claims should not be limited to the description of the embodiments contained herein.

What is claimed is:

1. A portable dispenser to dispense material from a replaceable refill cartridge comprising:

a housing having a receiving cavity to removably receive the refill cartridge, said housing adapted to carry a battery;

a pump carried by said housing, said pump having an inlet and an at least partially transparent outlet nozzle that is disposed through said housing, wherein said pump is in direct contact with the battery;

an at least partially transparent tube extending from said inlet of said pump into said receiving cavity to receive material from the refill cartridge;

a light source carried by said housing, said light source generating light that is in optical communication with said tube and said outlet nozzle; and a switch directly supporting said battery, said switch coupled to said light source, wherein when said pump is actuated, said pump dispenses material from the refill container and said pump moves the battery is into electrical communication with said switch, whereupon said switch is actuated to activate said light source to illuminate said outlet nozzle and said tube.

2. The portable dispenser of claim 1, wherein said pump comprises a dome pump.

3. The portable dispenser of claim 1, wherein said housing is at least partially transparent.

4. The portable dispenser of claim 1, wherein said housing carries at least partially transparent indicia thereon that is in optical communication with the light generated by said light source.

5. The portable dispenser of claim 4, wherein said indicia comprises a lenticular image.

6. The portable dispenser of claim 1, wherein said housing is at least partially transparent.

7. The portable dispenser of claim 1, wherein said light source is carried within a cavity defined by said housing, said light source adjacent to the refill cartridge when inserted therein.

* * * * *

UNITED STATES PATENT AND TRADEMARK OFFICE

CERTIFICATE OF CORRECTION

PATENT NO. : 8,757,443 B2
APPLICATION NO. : 13/233719
DATED : June 24, 2014
INVENTOR(S) : Keith A. Pelfrey, William Krueger and Michael M. Potempa It is certified that error appears in the above-identified patent and that said Letters Patent is hereby corrected as shown below:

In the Claims

Column 10, Claim 1, line 52 approximately, "battery is into" should be --battery into--.

Signed and Sealed this
Thirtieth Day of December, 2014

Michelle K. Lee

Michelle K. Lee
*Deputy Director of the United States Patent and Trademark Office*